US007347153B2

(12) United States Patent
Nakata et al.

(10) Patent No.: US 7,347,153 B2
(45) Date of Patent: Mar. 25, 2008

(54) THREAD SUPPLYING DEVICE OF SEWING MACHINE

(75) Inventors: Norio Nakata, Toyonaka (JP); Hiromichi Kurata, Toyonaka (JP); Takayoshi Masaoka, Toyonaka (JP)

(73) Assignee: Yamato Sewing Machine Seizo Co., Ltd., Osaka-shi, Osaka-fu (JP)

( * ) Notice: Subject to any disclaimer, the term of this patent is extended or adjusted under 35 U.S.C. 154(b) by 0 days.

(21) Appl. No.: 11/601,045

(22) Filed: Nov. 17, 2006

(65) Prior Publication Data

US 2007/0119353 A1 May 31, 2007

(30) Foreign Application Priority Data

Nov. 17, 2005 (JP) ..... 2005-364003

(51) Int. Cl.
*D05B 47/00* (2006.01)
*D65H 57/00* (2006.01)

(52) U.S. Cl. ..... 112/302

(58) Field of Classification Search ..... 112/302, 112/254, 255, 80.7, 80.73, 278, 279, 220
See application file for complete search history.

(56) References Cited

U.S. PATENT DOCUMENTS 2,696,608 A * 12/1954 Hangartner ..... 340/677
2,746,410 A * 5/1956 Passons ..... 112/254
3,556,029 A * 1/1971 Eigenmann ..... 112/254
4,408,554 A * 10/1983 Takiguchi et al. ..... 112/302
6,467,419 B2 * 10/2002 Hori ..... 112/302

FOREIGN PATENT DOCUMENTS

JP 11322195 11/1999
JP 200202179 7/2000

* cited by examiner

*Primary Examiner*—Ismael Izaguirre
(74) *Attorney, Agent, or Firm*—D. Peter Hochberg; Sean F. Mellino

(57) ABSTRACT

A thread supplying device includes a rotator feeding a thread downstream of a thread supply path, the rotator winding a periphery thereof the thread several times and locating in the path extending from a thread supply part to a needle and loopers, a stepping motor continuously drivingly rotating in one way the rotator in synchronism with the main shaft of a sewing machine, thread feed setting means setting a unit thread feeding amount necessary for formation of seams per stitch, and control means automatically controlling the rotation of the motor to feed the unit thread feeding amount set by the setting means for each formation of seams per stitch. This device can stably supply a predetermined amount of the unit thread, and achieve stabilization of stitch performance, irrespective of the type of the thread, and whether the feed of a fabric increases or decreases by a rapid change in the rotational speed of the sewing machine.

9 Claims, 6 Drawing Sheets

THREAD SUPPLYING DEVICE OF SEWING MACHINE

RELATED APPLICATION

Priority is claimed to Japanese Patent Application No. 2005-364001 filed on Nov. 17, 2005, the disclosure of which is incorporated by reference in its entirety.

BACKGROUND OF THE INVENTION

1. Field of the Invention

The present invention relates to a thread supplying device of a sewing machine. Particularly, the present invention relates to a thread supplying device applied to, for example, the case of supplying a needle thread, being called an upper thread, to a needle producing a combined movement, namely up and down, and from side to side, in a lock stitch (zigzag stitch) sewing machine, and the case of supplying a needle thread, and upper and lower looper threads to a needle moving vertically, and upper and lower loopers, respectively, in an over lock machine. This sewing machine is disposed on a thread supply path extending from a thread supplying part such as a thread cone to a movable sewing member including loopers, so that it can sequentially feed and supply the threads as a sewing operation advances.

2. Description of Related Art

As a thread supplying device of a sewing machine of this type, a generally known one has the following construction. That is, in order to avoid an excess or insufficient feed of a thread even when the type of a thread or the speed of sewing is changed, a pressure regulating mechanism enabling adjustments of the pinch pressure of the thread in a tension disk, a pair of rollers, a tension pulley, and the like, as well as adjustments of the feed resistance of the thread, is disposed at any point along a thread supply path. An operator adjusts or sets in advance the pinch pressure (hereinafter referred to as pressure regulation) of the thread by means of the pressure regulating mechanism before starting a sewing operation in accordance with the type of the thread and the speed of supply of the thread.

In the conventional thread supplying device having the above-mentioned pressure adjusting mechanism, a laborious pressure adjusting operation is required whenever the type of a thread used is changed as a sewing operation is advanced. Particularly, when using a flexible thread, the amount of feed of the thread varies greatly as the sewing machine is speeded up and down. It is therefore difficult to perform an adequate handling, and hence the amount of feed of the thread is unstable. In addition, if the rotational speed of the sewing machine is changed rapidly and the amount of feed of a fabric is increased or decreased greatly, it is difficult to have the amount of feed of the thread sufficiently track its great increase or decrease, from the viewpoint of the response characteristic of the above-mentioned pressure adjusting mechanism. It is therefore unavoidable that the amount of feed of the thread becomes excessive or insufficient, failing to stabilize stitch performance.

On the other hand, for example, Japanese Unexamined Patent Publication No. 2000-202179 discloses one having a rotary thread feeding mechanism. That is, a pulley is provided in a motor rotatable in synchronism with and working with the vertical movement of a needle, and the advance and retraction of upper and lower loopers. By driving the motor in forward or reverse direction, an upper thread and a looper thread wound around the pulley are fed or pulled back (returned).

In textile machinery such as a knitting machine, a hosiery machine, and a bobbin winding machine, for example, Japanese Unexamined Patent Publication No. 11-322195 discloses the following construction. That is, thread tension detecting apparatus and thread speed measuring apparatus are provided together, and the speed of supply of the thread supplied to the textile machinery is automatically controlled by controlling the number of revolutions of a drive pulley so that both of tension and speed of the thread are maintained constantly.

However, the conventional rotary thread supplying device as disclosed in the above Publication No. 2000-202179 lacks tracking because the feed and pullback of the thread are alternately repeated by the forward or reverse rotation of the thread feeding mechanism, namely being so-called intermittent thread feeding. Especially, if the feed of a fabric is largely increased or decreased with a rapid change in the rotational speed in a high-speed rotation range, the feed of the thread cannot be stabilized. Further, due to the alternative repetition of the feed and pullback of the thread, the thread extending between the thread supply part including the thread cone and the movable sewing member including the needle and the loopers is liable to swing widely, and the swing thereof may occur frequently, causing the likelihood of the thread mating together and being caught. This may increase the likelihood that the stitch performance itself will become unstable.

On the other hand, the thread supplying device in the textile machinery such as the knitting machine as disclosed in the above Patent Publication No. 11-322195, the thread is supplied to the machine (the knitting machine) by controlling the number of revolutions of the drive pulley based on the detections of the thread tension and the thread speed. When this thread supplying device is applied to a sewing machine, it fails to track the high-speed rotation of the sewing machine, making it impossible to avoid unstable stitch performance. This is because the thread supplying device of the sewing machine requires a different function from the knitting machine or the like in which a thread supplied causes less change in thread tension, that is, a complicated control of rotation along with the intermittent driving. Specifically, in response to thread tensions to be detected in the tension state and the tension released state of the thread because of the vertical movement of the needle along with the rotation of the sewing machine, and the advance and retraction of the loopers, the drive pulley is rotated at high speed, or stopped or rotated at low speed, in order that the thread is fed when applying tension, and the feed of the thread is stopped or delayed when releasing the tension.

SUMMARY OF THE INVENTION

To overcome the foregoing problems encountered in the conventional thread supplying devices, the present invention has for its object to provide a thread supplying device of a sewing machine that can stably supply a predetermined amount of a unit thread necessary for formation of seams per stitch, and achieve the stabilization of stitch performance, irrespective of the type of a thread, and if the amount of feed of a fabric is greatly increased or decreased by a rapid change in the rotational speed in a high-speed rotation range of the sewing machine.

According to the present invention, there is provided a thread supplying device of a sewing machine disposed at any point along a thread supply path extending from a thread supply part to a movable sewing member including a needle.

The thread supplying device includes a rotator, a motor, a thread feed setting apparatus, and a control apparatus. The rotator winds a thread around a periphery thereof at least one or more times, and is capable of feeding the thread downstream of the thread supply path. The motor continuously drivingly rotates in one way the rotator in synchronism with a main shaft of the sewing machine. The thread feed setting apparatus sets a unit thread feeding amount necessary for formation of seams per stitch. The control apparatus automatically controls an amount of rotation of the motor so as to feed a thread of the unit thread feeding amount set by the setting apparatus for each formation of seams per stitch.

In this thread supplying device, before starting a sewing operation, merely by causing the thread feeding amount setting apparatus to perform initial setting of the unit thread feeding amount necessary for formation of seams per stitch, the rotator continuously rotating in the one direction can satisfactorily track an increase and a decrease in the amount of feed of a fabric due to a rapid change in the rotational speed of the sewing machine, irrespective of the type of the thread and the presence or absence of flexibility. This enables the set unit amount of the thread to be always fed surely and stably.

Further, since the thread can be fed continuously, not intermittently, the swing of the thread is extremely small in the path from the thread supply part including the thread cone to the movable sewing member including the needle and the loopers, and hence there is no likelihood of the thread mating together and being caught. This contributes to the stabilization of stitch performance itself. In addition, the total consumption of the thread can be found accurately by multiplying the unit thread feeding amount set by the setting apparatus by the number of stitches. This permits an exact thread management such as the time to supply the thread.

Before the sewing operation, by setting the thread feeding amount during chain-off sewing after a normal sewing operation to the fabric, so as to be smaller than that during the normal sewing operation, a waste of the thread during the chain-off sewing can be eliminated. This leads to a reduction in the total consumption of the thread. Further, there is no need for disposing any pressure adjusting mechanism for adjusting the thread feed resistance in the thread supply path. This simplifies the construction and achieves labor saving of laborious operation.

In the thread supplying device of a sewing machine according to the present invention, by controlling the amount of rotation of the motor for driving the rotator based on the initialization of the unit thread feeding amount, the thread feeding amount can be controlled adequately and stabilized, irrespective of the change in thread tension, and whether, or not there is a shoulder on a fabric. Hence, it is not essential to equip the apparatus for detecting thread tension and the apparatus for detecting a fabric shoulder in the thread supply path.

Preferably, the thread tension detecting apparatus may be disposed downstream of the rotator in the thread supply path so that the control apparatus controls the amount of rotation of the motor so as to increase or decrease depending on the magnitude of a thread tension detected by the thread tension detecting apparatus.

With this construction, the amount of feed of a thread can be subjected to fine adjustment (increment) relative to the initialization value in accordance with the change of thread tension when the number of revolutions of the sewing machine is decreased or increased. It is therefore capable of coping with any change of stitch performance due to switching between the high speed and the low speed of the sewing machine. This achieves stable stitch performance.

Alternatively, the fabric shoulder detecting apparatus for detecting whether or not a fabric has a shoulder may be disposed ahead of a sewing part in a fabric feed direction, in order to control so that, when a shoulder is detected by the fabric shoulder detecting apparatus, the amount of rotation of the motor under the control of the control apparatus is increased relative to when no shoulder is detected. This permits a further improvement in the supply performance of the thread.

With this construction, when the fabric has a shoulder, a control delay may be generated by the amount of one or two stitches, and the thread may be temporarily tensioned by this delay. However, the occurrence of broken thread can be suppressed, and any adverse effect cannot be exerted on the formation of seams.

Other objects and advantages of the present invention will become more apparent from the following detailed description of the present invention when taken in conjunction with the accompanying drawings.

DESCRIPTION OF PREFERRED EMBODIMENTS

Figure 1:
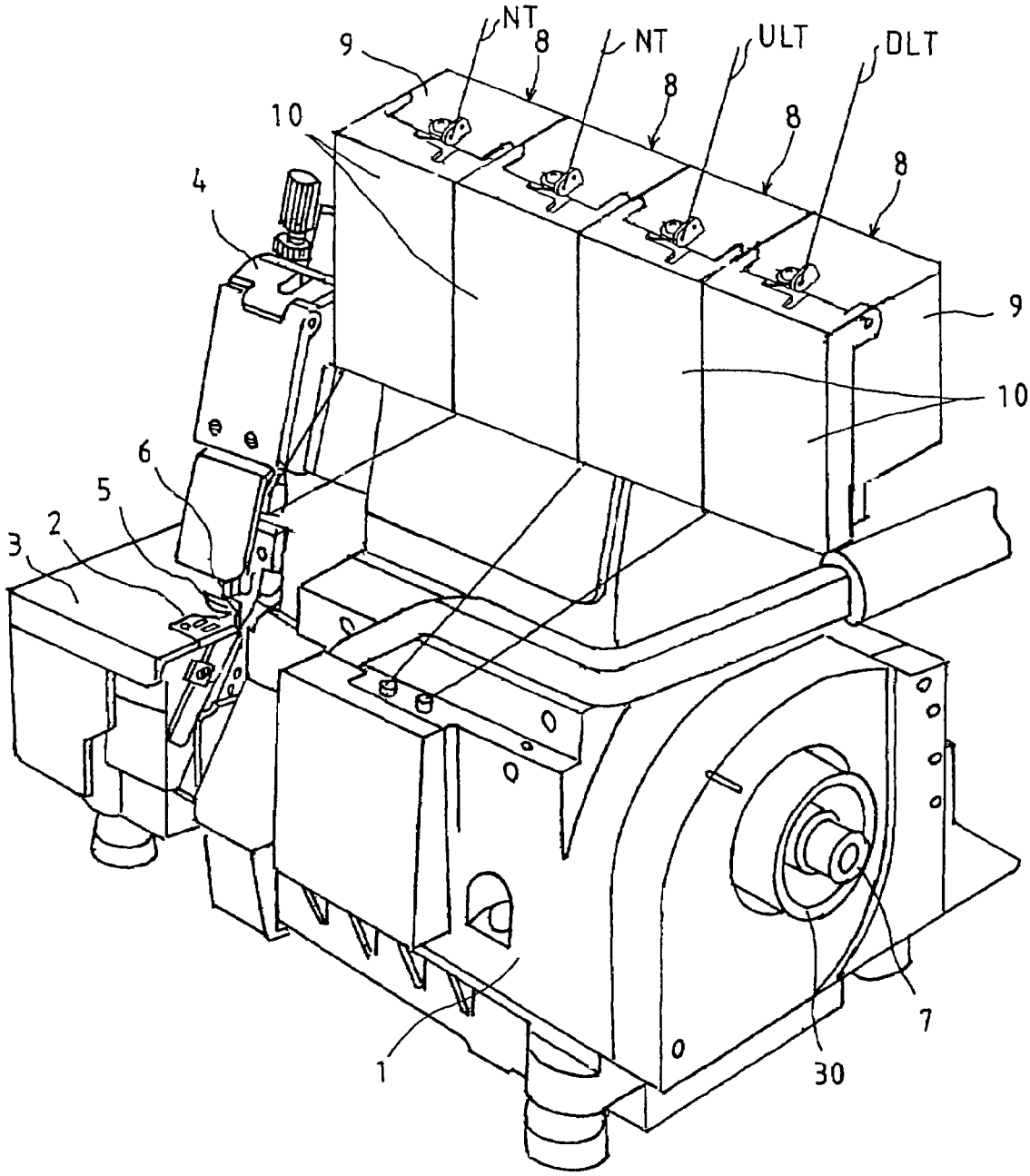
FIG. 1 is a schematic perspective view of the overall of an over lock machine equipped with a thread supplying device according to a first preferred embodiment of the present invention.
Figure 2:
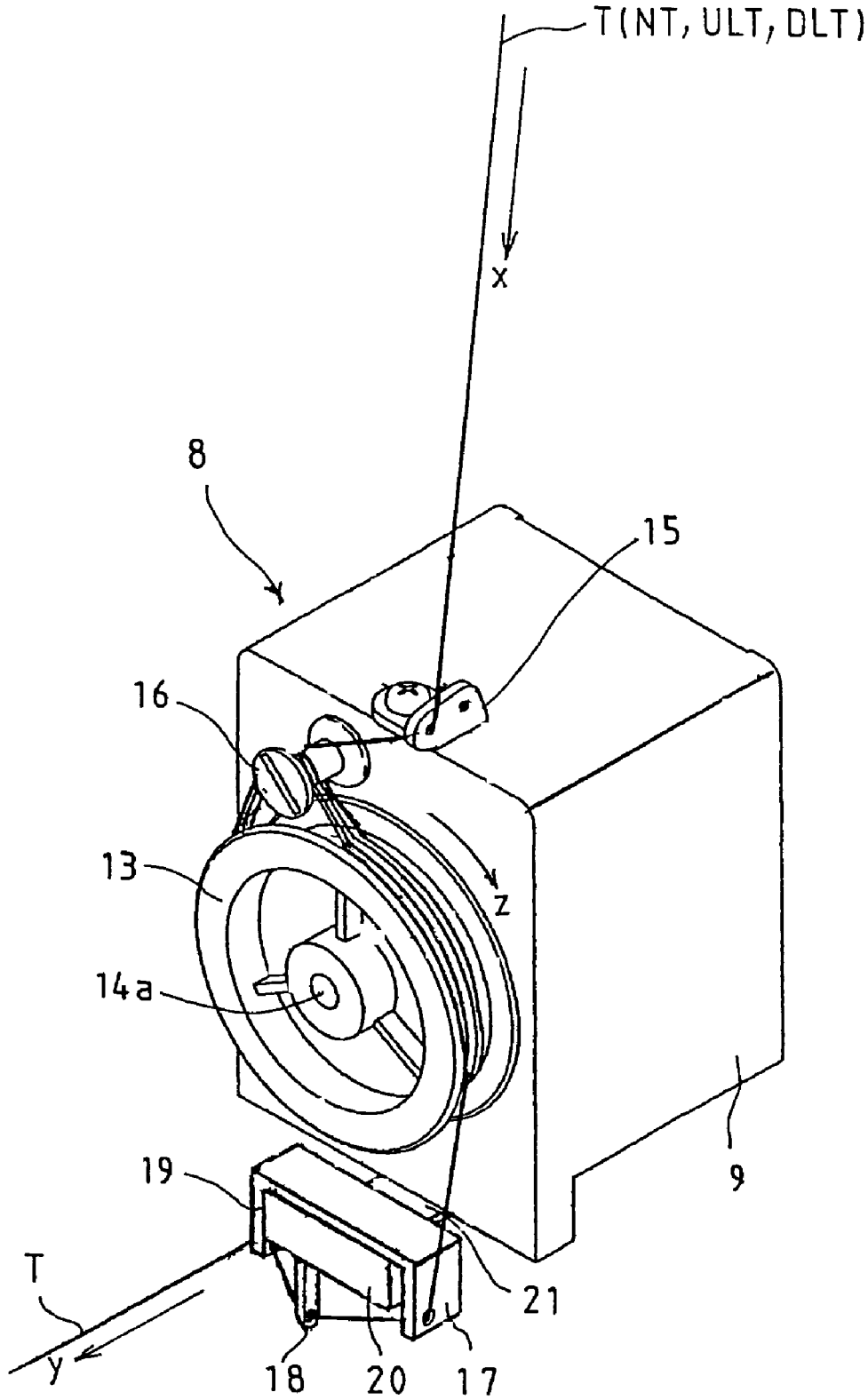
FIG. 2 is a perspective view illustrating in enlarged dimension the thread supplying device being a key part.
Figure 3:
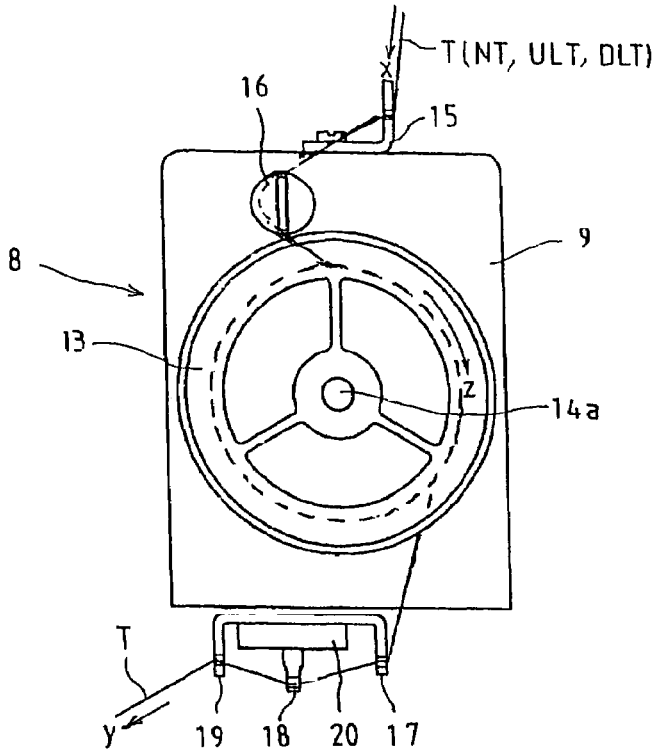
FIG. 3 is a front view of the thread supplying device.
Figure 4:
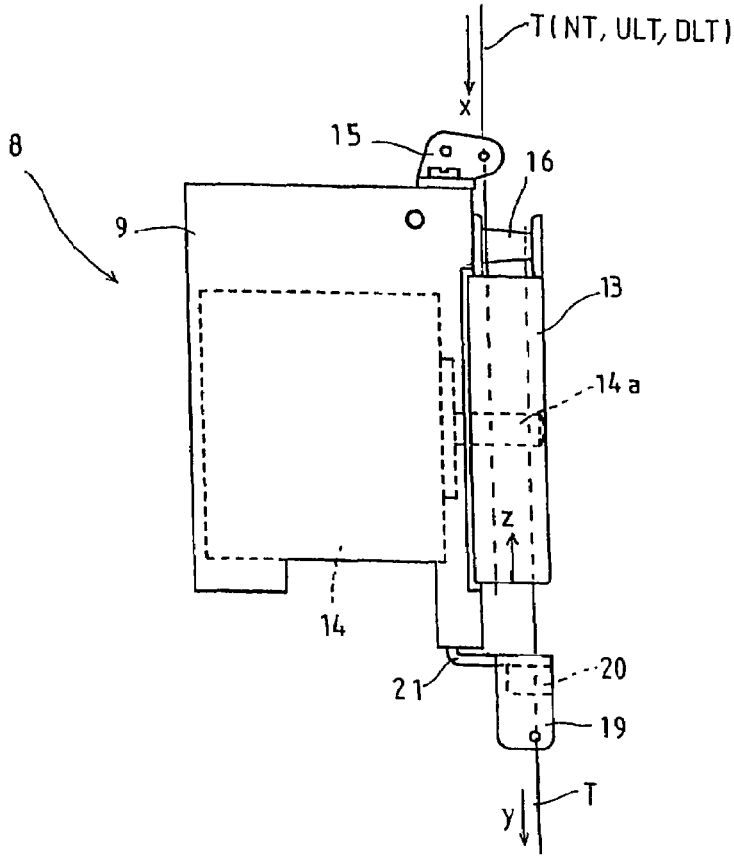
FIG. 4 is a side view of the thread supplying device.
Figure 5:
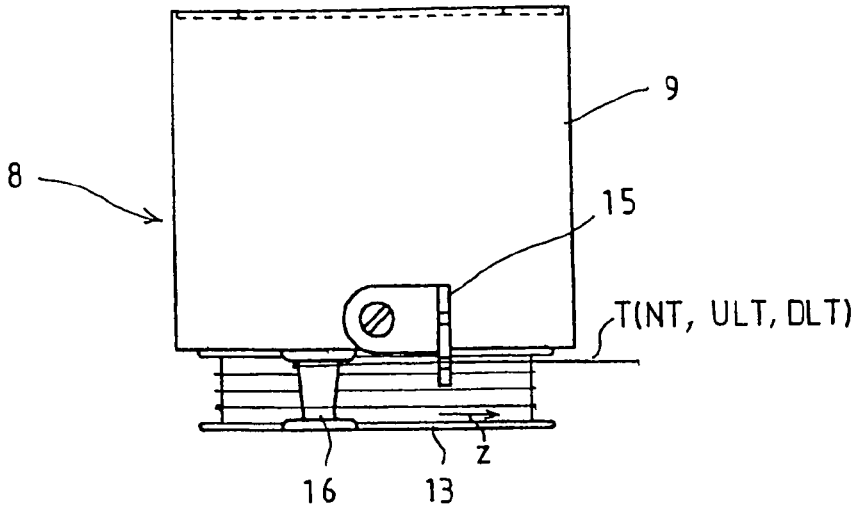
FIG. 5 is a plan view of the thread supplying device.

FIG. 1 is a schematic perspective view of the overall of an over lock machine equipped with a thread supplying device according to a first preferred embodiment of the present invention. In FIG. 1, reference numeral 1 denotes a machine frame. A cross plate 3 with a throat plate 2 attached thereto is disposed at a lower part on the left side of the frame 1, and a fabric presser foot 5 and two needles (one of a movable sewing member) 6 interlocking with and in synchronism with a main shaft 7, and the like are disposed at a machine head part 4 in an upper part on the left side of the frame 1. A pair of upper and lower loopers (the other of the movable sewing member) are disposed so as to be able to advance and retract with respect to a needle location at lateral opposite positions with the needle 6 interposed therebetween. Since the loopers and its operation mechanism are well known the plotting and description thereof are omitted.

In an upper part of the frame 1, four thread supplying devices 8 are arranged side by side on and fixed to a mounting plate (not shown) or the like. The thread supplying devices 8 are disposed along a thread supply path extending from a thread supply part such as a thread cone (not shown) up to the needle 6 and the upper and lower loopers, and they individually supply two needle threads NTs, an upper looper thread ULT, and a lower looper thread DLT. The four thread supplying devices 8 are of identical structure, each having a box type device body 9 opening into a forward surface, and a cover 10 attached to the forward surface so that it can open and close. A main part for feeding a thread to be described later is housed in between the cover 10 and the device body 9, and in the inside of the device body 9. In FIG. 1, only the device bodies 9 and the covers 10 of the thread supply devices 8 are shown and reference numeral 30 denotes a machine pulley.

Each of the thread supply devices 8 is constructed as shown in FIGS. 2 to 5. A pulley-like rotator 13 is disposed in the forward opening part of the device body 9. The rotator 13 can feed the thread T (being a generic name of the needle threads NTs, the upper and lower looper threads ULT and DLT) fed in the direction of the arrow X from the upstream side of the thread supply path in the following manner. That is, the thread T is passed through a tension thread guard 15 and a tension thread guard shaft 16 each being fixed to an upper part of the device body 9, and wound around the periphery thereof one or more times, particularly, three to five times or more in order to prevent a slip at the time of feed, and then passed through right, middle, and left thread paths 17 to 19, each being fixed to a lower part of the device body 9, to the downstream side of the thread supply path indicated by the arrow Y. The pulley-like rotator 13 is directly connected to an output rotary shaft 14*a* of the stepping motor 14, which is housed and held within the device body 9 interlocking with and in synchronism with the main shaft 7, and constructed so that it can be continuously drivingly rotated in one direction as indicated by the arrow Z, via the stepping motor 14.

To a position immediately below the forward opening part of the device body 9 on the downstream side of the rotator 13 in the thread supply path, a thread tension sensor 20 as thread tension detecting apparatus is attached via a mount 21 extending forward from a lower part of the device body 9. The middle thread path 18 from among the thread paths 17 to 19 is firmly fixed to the lower surface of the thread tension sensor 18.

Figure 6:
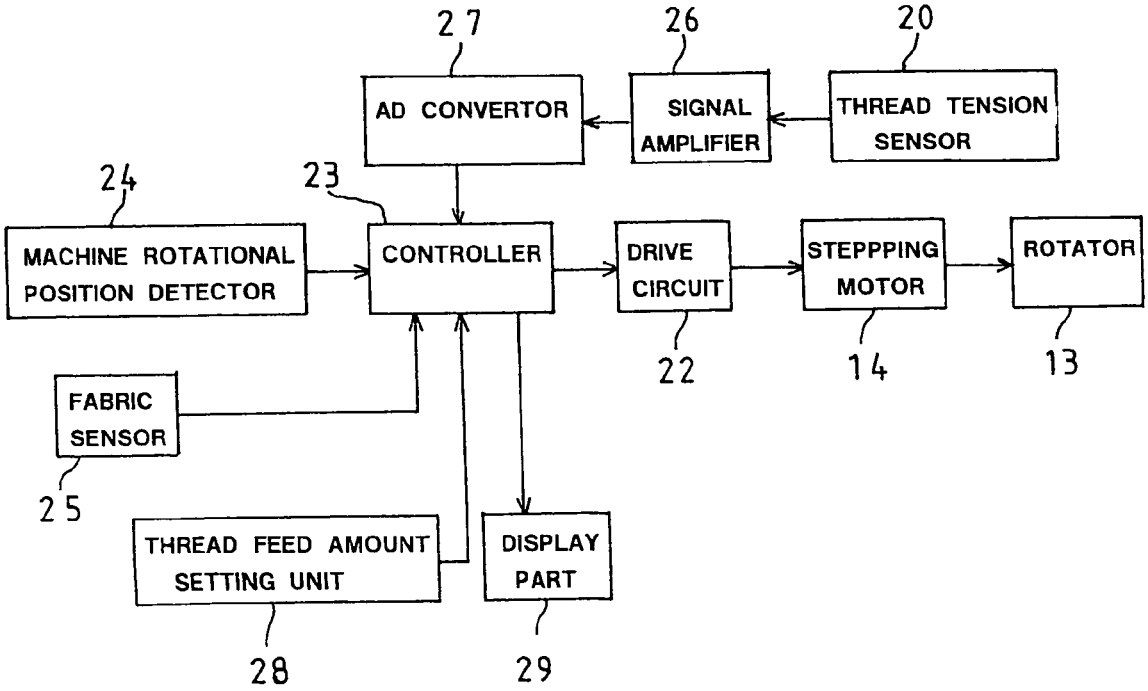
FIG. 6 is a block diagram of a control block in the thread supplying device.

FIG. 6 is a block diagram of a control block in the thread supply devices 8. The stepping motor 14 directly connected to the rotator 13 is controlled so as to drivingly rotate via a drive circuit 22, based on a rotational control signal outputted from a controller 23. The controller 23 is configured to receive a detection signal from a machine rotational position (angle) detector 24, a detection signal from a fabric sensor 25 for detecting whether a fabric is present or not on the throat plate 2, and a tension detection signal detected by the thread tension sensor 20 and then passed through a signal amplifier 26 and an AD converter 27. Further connected to the controller 23 are a thread feed setting unit 28, which sets a unit thread feeding amount necessary for formation of seams per stitch by using a numerical input, and a display part 29, which displays a total consumption of the thread that can be calculated by multiplying the unit thread feeding amount set by the setting unit 28 by the number of stitches. Although FIG. 6 merely shows a block configuration related to the control of feed of a single thread T, it is of course that in the present embodiment, four drive circuits and four thread tension sensors are connected to the controller 23.

Next, a description will be made of the operation of the thread supplying devices 8 in an over lock machine thus constructed.

First, before starting a sewing operation, the unit thread feeding amounts necessary for formation of seams per stitch of the respective threads T, such as the needle threads NTs, the upper and lower looper threads ULT and DLT, are initialized in the thread feeding amount setting unit 28 by numerical inputs in accordance with the type of the thread and the type of the fabric. At this time, the thread feeding amount during chain-off sewing at the beginning and ending of sewing where no fabric is present in the sewing part, is set so as to be less than that during normal sewing where a fabric is present in the sewing part. When the respective threads NTs, ULT, and DLT are passed through the needle 6 and the upper and lower loopers, a main switch (not shown) of the machine motor is turned off, and hence a rotary switch (not shown) of the stepping motor 14 is turned off, and then the necessary amount of the thread is fed by manually rotating the rotator 13.

Upon completion of the initialization of the thread feeding amounts as described above, the rotational switch of the stepping motor 14 is turned on to activate and rotate the sewing machine. Thereby, in synchronism with the rotation of the main shaft 7 of the sewing machine, the needle 6 reciprocates up and down, and the upper and lower loopers advance and retract. At the same time, a detection signal from the machine rotational position detector 24 and a detection signal from the fabric sensor 25 are inputted to the controller 23. Based on a rotational control signal outputted from the controller 23 and then inputted to the drive circuit 22, the stepping motor 14 is controlled so as to drivingly rotate.

Under the control of the rotation of the stepping motor 14, the rotator 13 is continuously rotated in one direction Z, and the respective threads NTs, ULT, and DLT can be fed to the needle 6 and the loopers by the unit feeding amount necessary for formation of seams per stitch, based on the initialization to the setting unit 28. This provides the normal sewing operation. Consequently, irrespective of the types of the threads NTs, ULT and DLT, the presence or absence of flexibility, and if the feed of a fabric increases or decreases by a rapid change in the rotational speed of the sewing machine, it is capable of satisfactorily tracking these matters to thereby surely and stably feed the set unit amount of the threads. Further, since the thread can be fed continuously, not intermittently, the swing of the thread is extremely small throughout the path from the thread supply part such as the thread cone to the needle 6 and the upper and lower loopers, and hence there is no likelihood of the thread mating together and being caught. This contributes to the stabilization of stitch performance itself.

In the normal sewing operation, the thread tension immediately after being fed from the rotator 13 is always detected by the thread tension sensor 20, and its detection signal is fed back via the signal amplifier 26 and the AD converter 27 to the controller 23, so that the amounts of rotations of the stepping motor 14 and the rotator 13 are controlled to increase or decrease. Hence, if the number of revolutions of the sewing machine is decreased or increased, the amount of feed of the thread can be subjected to fine adjustment (to be increased or decreased) with respect to the initialization value, in response to a change in thread tension. It is therefore capable of coping with any change in the amount of the thread used per stitch due to switching between the high speed and the low speed of the sewing machine. This achieves stable stitch performance.

Further, the total consumption of the thread can be found accurately by causing the controller 23 to multiply the unit thread feeding amount set by the thread feed setting apparatus by the number of stitches, and causing the display part 29 to display the value obtained by the multiplication. This permits an exact thread management such as the time to supply the thread to the thread supply part.

Furthermore, in the initialization to the setting unit 28, by setting the thread feeding mount during chain-off sewing at the beginning and ending of sewing where no fabric is present on the throat plate 2 being the sewing part, so as to be smaller than that during the normal sewing operation, a waste of the thread during the chain-off sewing can be eliminated, thus leading to a reduction in the consumption of the thread through out the sewing operation.

Figure 7:
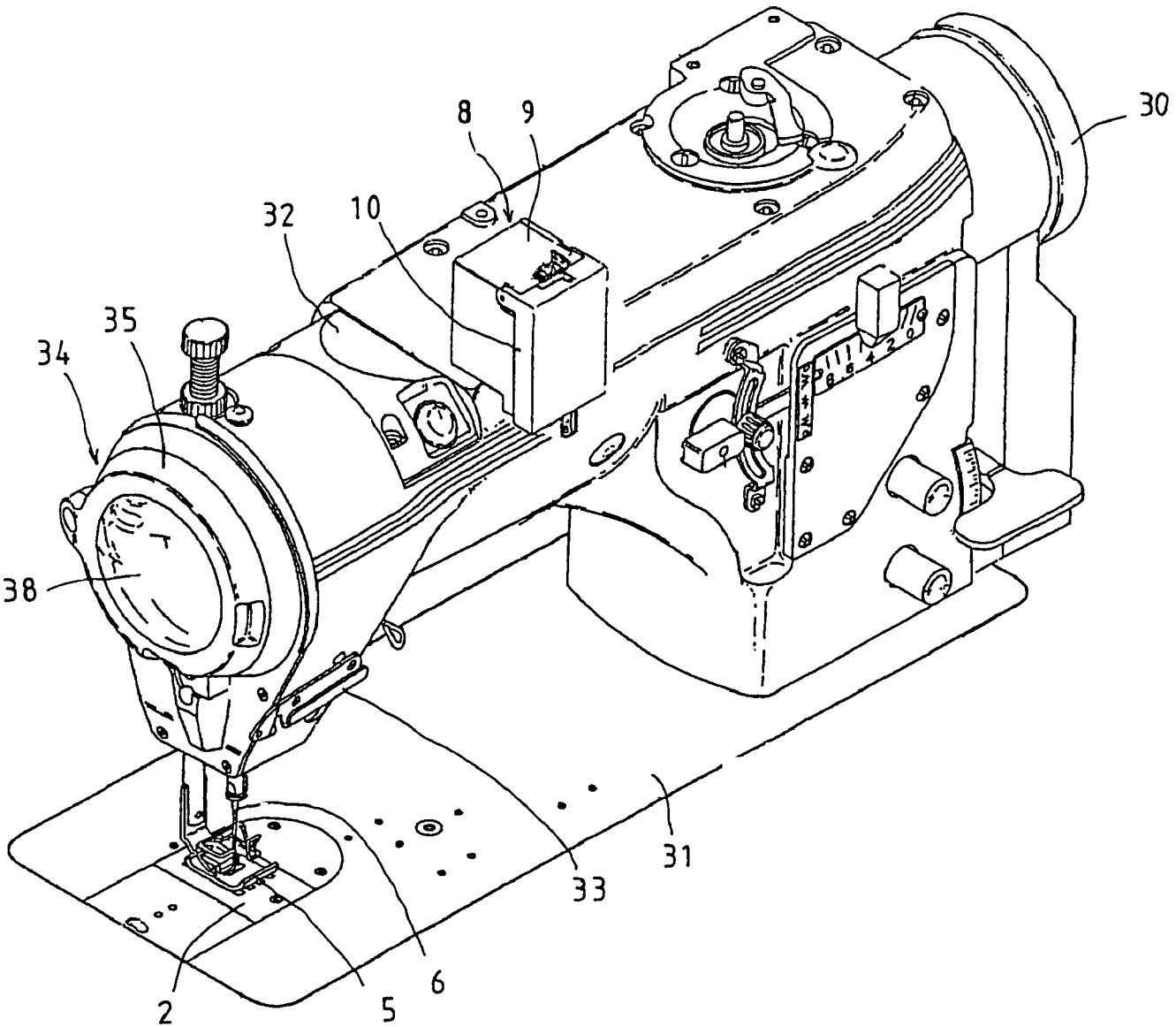
FIG. 7 is a schematic perspective view of the overall of a zigzag sewing machine equipped with a thread supplying device according to a second preferred embodiment of the present invention.
Figure 8:
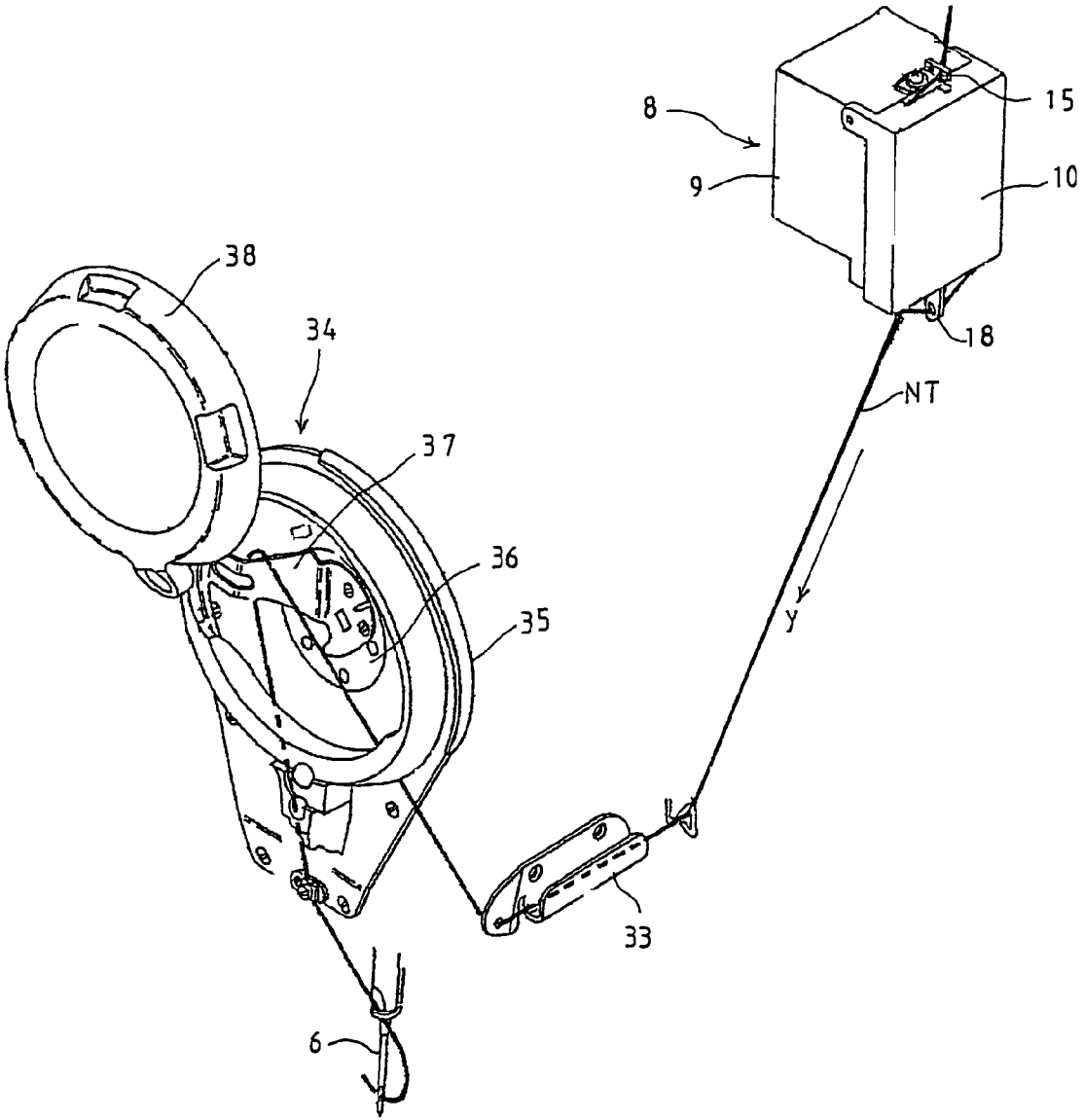
FIG. 8 is an enlarged perspective view of a key part including the thread supplying device.

FIG. 7 is a schematic perspective view of the overall of a zigzag (lock stitch) sewing machine equipped with a thread supplying device according to a second preferred embodiment of the present invention. FIG. 8 is an enlarged perspective view of the part key part illustrating the construction of a thread supply path in the zigzag sewing machine.

In this zigzag sewing machine, a throat plate 2 is disposed on a bed 31, and a thread supply device 8 is fixed to a mounting plate (not shown) at substantially a mid-portion of an arm 32. The thread supply device 8 is disposed along a thread supply path extending from a thread supply part such as a thread cone to a needle 6, and it feeds and supplies a needle thread (an upper thread) NT to the needle 6 via a fixed tension thread guard 33 and a needle thread take-up mechanism 34. No thread supply device for a lower thread is disposed because there is no space for disposing a motor and the like under the throat plate 2.

The thread take-up mechanism 34 is constructed of a needle thread take-up guard 35 for forming a grooved space fixed to a tip portion of the arm 32, a needle thread take-up 37 fixed to a rotating disk 36 supported in the grooved space of the thread take-up guard 35 so as to be able to rotate in synchronism with a main shaft 7, a needle thread take-up guard cover 38 attached to a forward opening part of the needle thread take-up guard 35 so as to be able to open and close. The thread supply device 8 has completely the same structure as that in the over lock sewing machine described in the first preferred embodiment. Therefore, the same reference numerals indicate like members and like parts as in the first preferred embodiment, and the description thereof is omitted.

In the thread supplying device 8 of the zigzag sewing machine in the second preferred embodiment, only a needle thread (an upper thread) NT is initialized to a setting unit 28 by a continuous rotation in one direction Z of a rotator 13 along with the control of rotation of a stepping motor 14. The normal sewing operation can be performed by feeding the needle thread NT to a needle 6 by a unit feeding amount necessary for formation of seams per stitch. Consequently, irrespective of the type of the thread NT, and the presence or absence of flexibility, and if the feed of a fabric increases or decreases by a rapid change in the rotational speed of the sewing machine, it is cable of satisfactorily tracking these matters thereby to surely and stably feed the thread of the set unit amount. Further, a continuous thread feed can minimize the swing of the thread throughout the path from the thread supply part such as the thread cone to the needle 6, and eliminate the likelihood of the thread mating together and being caught. This contributes to the stabilization of stitch performance itself. When the number of revolutions of the sewing machine is decreased or increased, the amount of feed of the thread can be subjected to fine adjustment (to be increased and decreased) with respect to the initialization value, in response to a change in thread tension. It is therefore capable of coping with any change in the amount of the thread per stitch due to switching between the high speed and the low speed of the sewing machine. This achieves stable stitch performance. That is, the second preferred embodiment also produces the same effect as in the first preferred embodiment.

In both of the first and second preferred embodiments of the present invention, a sensor (not shown) for detecting a shoulder on a fabric is preferably disposed ahead of the sewing part in the fabric feed direction, so that it is controlled to increase the amount of rotation of the stepping motor 14 under the control of the controller 23 when the sensor detects a shoulder than that when no shoulder is detected. In this case, a delay of control may occur by the amount of one or two stitches, and the thread may be temporarily tensioned by this delay. However, the occurrence of broken thread can be surely suppressed, and any adverse effect cannot be exerted on the formation of seams, enabling better seams to be formed.

Since the present invention does not necessarily require the pressure adjusting mechanism for enabling adjustments of the thread pinch pressure such as the tension disc, the pair of rollers, and the tension pulley, as well as thread feed resistance, the foregoing embodiments have been described on the assumption that no pressure adjusting mechanism is equipped. Alternatively, the pressure adjusting mechanism may be equipped to maintain thread tension constant or substantially constant. It is however unnecessary to control the pressure adjustment by means of the pressure adjusting mechanism in the course of a sewing operation.

Although any type of motor may be used as the motor 14 in the thread supplying device 8, in particular, the use of a stepping motor assures control exhibiting superior response characteristic when the initialized unit feeding amount changes momently, thus permitting more excellent sewing operation.

The thread supplying devices of the present invention are applicable to other sewing machines such as double chain stitch sewing machines, and the same effect is attainable.

What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. A thread supplying device for a sewing machine, the sewing machine having a main shaft, disposed at any point in a thread supply path extending from a thread supply part to a movable sewing member including a needle, the thread supplying device comprising:

a rotator having a thread winding around a periphery of said rotator at least one time, wherein the rotator feeds the thread downstream of the thread supply path;

a motor continuously drivingly rotating said rotator in one direction and in synchronism with said main shaft of the sewing machine;

a thread feed setting apparatus for setting a unit thread feeding amount necessary for forming seams per stitch;

a thread tension detecting apparatus located downstream of the rotator in the thread supply path; and a control apparatus for automatically controlling an amount of rotation of the motor for feeding a thread of the unit thread feeding amount set by the setting apparatus for each formation of seams per stitch, wherein said control apparatus changes the amount of rotation of the motor depending on a magnitude of a thread tension immediately after being fed from the rotator and detected by the thread tension detecting apparatus.

2. The thread supplying device for a sewing machine according to claim 1, wherein said thread supplying device further comprises a box-type device body for supporting the rotator and the motor, and wherein the thread tension detecting apparatus is provided on a downstream side of the rotator in the thread supply path and immediately below said box-type device body.

3. The thread supplying device for a sewing machine according to claim 1, wherein a number of winding of a thread wound around the periphery of the rotator is set to at least three to five times.

4. The thread supplying device for a sewing machine according to claim 1, wherein the motor is a stepping motor.

5. The thread supplying device for a sewing machine according to claim 1, further comprising a fabric shoulder detecting apparatus for detecting whether a fabric has a shoulder, wherein the fabric shoulder detecting apparatus is located ahead of a sewing part in a fabric feed direction, and wherein the amount of rotation of the motor controlled by the control apparatus is increased when a shoulder is detected by the fabric shoulder detecting apparatus, relative to when no shoulder is detected.

6. The thread supplying device for a sewing machine according to claim 1, further comprising a calculation and display apparatus for calculating and displaying a total consumption of a thread, wherein said calculation and display apparatus multiplies the unit thread feeding amount set by the thread feed setting apparatus by a number of stitches.

7. The thread supplying device for a sewing machine according to claim 1, wherein any pressure adjusting apparatus for adjusting thread feed resistance is not provided along the thread supply path.

8. The thread supplying device for a sewing machine according to claim 1, wherein the thread supplying device is provided at any point in a thread supply path of an upper thread in a zigzag sewing machine having a needle-thread take-up mechanism.

9. A thread supplying device for a sewing machine, the sewing machine having a main shaft, disposed at any point in a thread supply path extending from a thread supply part to a movable sewing member including a needle, the thread supplying device comprising:

a rotator having a thread winding around a periphery of said rotator at least one time, wherein the rotator feeds the thread downstream of the thread supply path;

a motor continuously drivingly rotating said rotator in one direction and in synchronism with said main shaft of the sewing machine;

a thread feed setting apparatus for setting a unit thread feeding amount necessary for forming seams per stitch;

a thread tension detecting apparatus located downstream of the rotator in the thread supply path; and a control apparatus for automatically controlling an amount of rotation of the motor for feeding a thread of the unit thread feeding amount set by the setting apparatus for each formation of seams per stitch, wherein said control apparatus changes the amount of rotation of the motor to increase or decrease depending on a magnitude of a thread tension detected by the thread tension detecting apparatus.

* * * * *

UNITED STATES PATENT AND TRADEMARK OFFICE

CERTIFICATE OF CORRECTION

PATENT NO. : 7,347,153 B2
APPLICATION NO. : 11/601045
DATED : March 25, 2008
INVENTOR(S) : Norio Nakata et al.

It is certified that error appears in the above-identified patent and that said Letters Patent is hereby corrected as shown below:

On title page, item (30) Foreign Application Priority Data, replace "2005-364003" with --2005-364001.--

Signed and Sealed this

First Day of July, 2008

JON W. DUDAS
*Director of the United States Patent and Trademark Office*